US007014166B1

(12) United States Patent
Wang

(10) Patent No.: US 7,014,166 B1
(45) Date of Patent: Mar. 21, 2006

(54) FAUCET DEVICE OPERATABLE EITHER MANUALLY OR AUTOMATICALLY

(76) Inventor: Hsiang Hung Wang, No. 15, Puwei Lane, Lugang Town, Changhua Hsien 505 (TW)

( * ) Notice: Subject to any disclaimer, the term of this patent is extended or adjusted under 35 U.S.C. 154(b) by 0 days.

(21) Appl. No.: 11/022,254

(22) Filed: Dec. 22, 2004

(51) Int. Cl.
*E03C 1/05* (2006.01)

(52) U.S. Cl. ..... 251/129.03; 251/129.04; 4/623

(58) Field of Classification Search ..... 251/129.03, 251/129.04; 4/623, 624
See application file for complete search history.

(56) References Cited

U.S. PATENT DOCUMENTS 5,445,181 A 8/1995 Kuhn et al. ..... 137/98
5,771,923 A 6/1998 Paterson et al. ..... 137/513.5
6,003,170 A * 12/1999 Humpert et al. ..... 4/623
6,305,663 B1 * 10/2001 Miller ..... 251/129.04
6,363,549 B1 * 4/2002 Humpert et al. ..... 4/623
6,874,535 B1 * 4/2005 Parsons et al. ..... 137/607

* cited by examiner

*Primary Examiner*—J. Casimer Jacyna
(74) *Attorney, Agent, or Firm*—Charles E. Baxley

(57) ABSTRACT

A faucet device includes a shank coupled to a water reservoir and having two outlets, a solenoid valve is coupled to one of the outlets of the shank, a faucet housing includes a chamber and includes an outlet spout. A valve casing is disposed in the faucet housing, and includes two passages coupled to the other outlet of the shank and an exit of the solenoid valve. An actuating device may selectively communicate either passage of the valve casing with the spout of the faucet housing, to allow the water from the shank and the solenoid valve to selectively flow out through the spout of the faucet housing, and to allow the faucet device to be selectively operated automatically or manually by users.

12 Claims, 5 Drawing Sheets

FAUCET DEVICE OPERATABLE EITHER MANUALLY OR AUTOMATICALLY

BACKGROUND OF THE INVENTION

1. Field of the Invention

The present invention relates to a faucet device, and more particularly to a faucet device selectively operatable automatically and/or manually by users.

2. Description of the Prior Art

Typical faucet devices or sinks comprise a valve device engaged or provided therein, and normally operated manually by users, to control either or both cold water and hot water out through the outlet nozzle of the faucets.

However, such typical faucets or sinks have many problems, particularly in a crowded office or institution, literally hundreds of persons may utilize a faucet or a sink, that naturally includes touching the faucet, sometimes with wet hands, such that germs or bacteria may be widely spread through the typical faucets or sinks.

For example, U.S. Pat. No. 5,445,181 to Kuhn et al. discloses one of the typical faucets or sinks or mixing valves that is also required to be touched and operated manually by users, and also may have a good chance to allow the germs or bacteria to be spread from people to people.

As the need to conserve water, especially in crowded urban environments, increased electronically controlled sensor activated valves were introduced. In these devices a sensor is focused in the sink area, and when hands are passed under the spout, the valve opens to allow water to flow out of the spout. When the hands are removed, the flow ceases.

For example, U.S. Pat. No. 5,771,923 to Paterson et al., discloses one of the typical faucet assemblies that include valves to be electronically controlled or activated by sensors.

While using the typical electronically controlled or activated faucet assemblies, the users have to have their hands passed under the spout, in order to open or to actuate the valve and thus to allow water to flow out of the spout. However, for some people, such as elders, young children, they may probably not know to pass their hands under the spout, such that the water may not flow out of the spout.

In addition, when electric energy or electric power is cut, the typical electronically controlled or activated faucet assemblies may no longer be actuated or operated, such that no water may be used in such situations.

The present invention has arisen to mitigate and/or obviate the afore-described disadvantages of the conventional faucets.

SUMMARY OF THE INVENTION

The primary objective of the present invention is to provide a faucet device selectively operatable automatically and/or manually by users, to allow the faucet device to be operated manually by the users without electric energy.

In accordance with one aspect of the invention, there is provided a faucet device comprising a shank for coupling to a water reservoir and for receiving water from the water reservoir, the shank including a space formed therein, and including a first outlet and a second outlet communicating with the space thereof, for allowing the water to flow out of the shank via either the first outlet or the second outlet of the shank, a solenoid valve including an entrance coupled to the second outlet of the shank, and including an exit, for receiving the water from the shank, and for controlling the water to selectively flow out through the exit thereof, a faucet housing including a chamber formed therein, and including a spout extended therefrom and communicating with the chamber thereof, to allow water to flow out of the faucet housing through the spout, a valve casing disposed in the chamber of the faucet housing, and including a first passage and a second passage formed therein, and coupled to the first outlet of the shank and the exit 33 of the solenoid valve respectively, for selectively receiving the water from the shank and the solenoid valve respectively, and an actuating device for selectively communicating the first passage and the second passage of the valve casing with the spout of the faucet housing, to allow the water from the shank to selectively flow out through the spout of the faucet housing, and to allow the water from the solenoid valve to selectively flow out through the spout of the faucet housing, such that the faucet device may be selectively operated automatically or manually by users.

The actuating device includes a receptacle disposed in the chamber of the faucet housing, the receptacle includes a first port and a second port provided therein and coupled to the first and the second passages of the valve casing respectively, to receive the water from the shank and the solenoid valve respectively, the receptacle includes a central bore formed therein and offset from the first and the second ports, and communicating with the spout of the faucet housing.

The actuating device includes an adapter rotatably received in the receptacle, and having an oblong hole formed therein, for selectively connecting the center bore of the receptacle with either the first port or the second port of the receptacle. The adapter includes a stem extended upwardly therefrom, and a cap attached to the stem, for rotating the adapter relative to the receptacle.

The receptacle includes a valve plate disposed in the receptacle, and having two apertures and a central pathway formed therein, and aligned with the first and the second ports and the central bore of the receptacle respectively, the oblong hole of the adapter selectively connects the central pathway of the valve plate with either of the apertures of the valve plate.

A remote detecting device may further be provided and coupled to the solenoid valve, to detect whether people are going toward the faucet housing or not, and to actuate the solenoid valve and to allow the water to selectively flow out through the exit of the solenoid valve, when the detecting device has detected that people are going toward the faucet housing. The receptacle includes a block secured to the valve casing, and the detecting device is secured to the block with a bracket.

The shank includes a filter device engaged therein, for filtering the water flowing into the shank. The shank includes a partition disposed in the space thereof, and the partition is disposed between the first and the second outlets of the shank. The partition includes an orifice formed therein, to allow the first and the second outlets of the shank to be communicated with each other.

The shank includes a valve element treaded thereto, and selectively engageable with the partition, to selectively block the orifice of the partition, and to selectively prevent the water from flowing out through the second outlet of the shank.

The faucet housing includes a peripheral protuberance radially extended into the chamber thereof, the valve casing includes a peripheral shoulder formed therein, for engaging with the peripheral protuberance of the faucet housing, and for securing the valve casing within the chamber of the faucet housing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
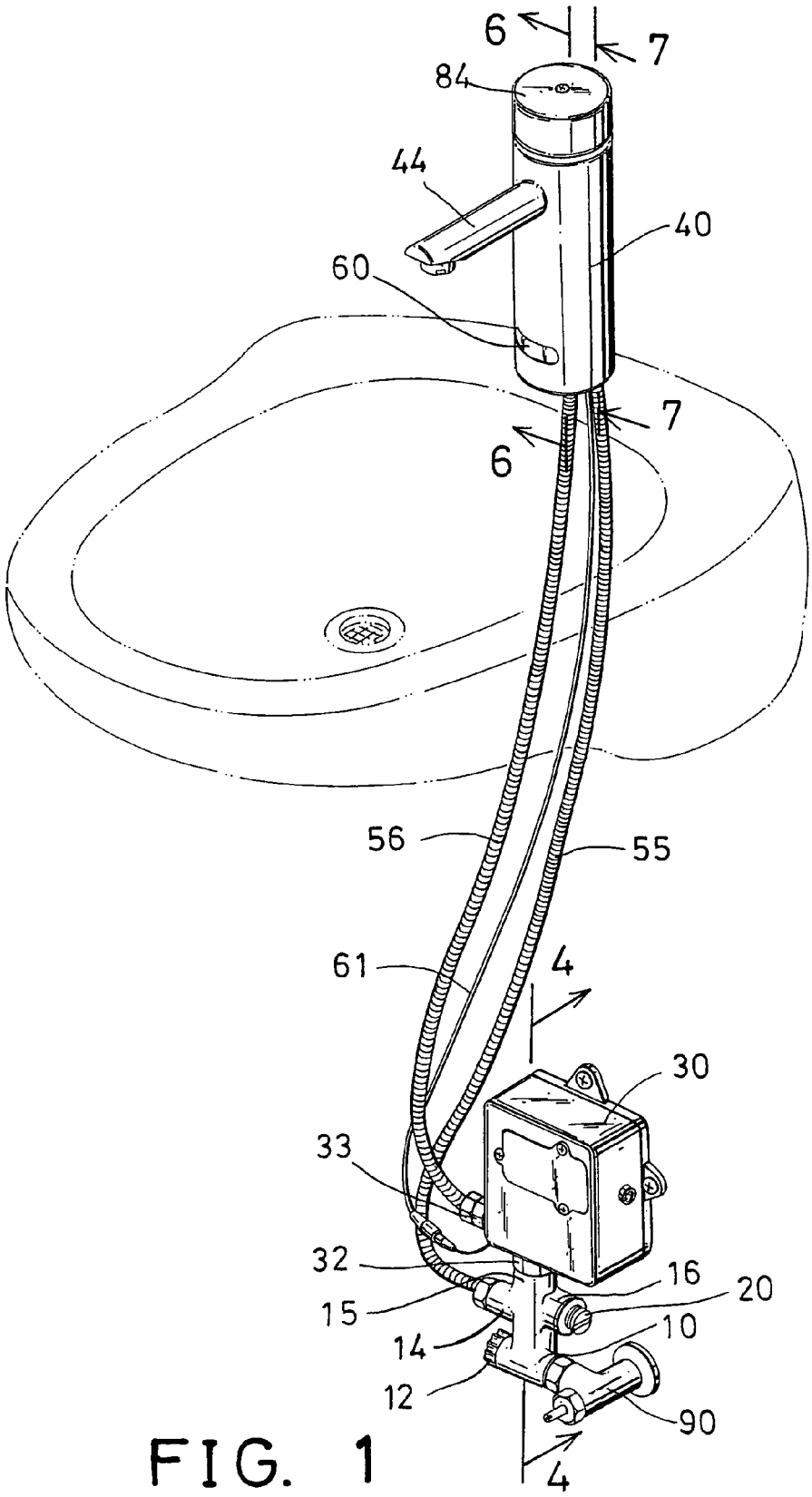
FIG. 1 is a perspective view of a faucet device in accordance with the present invention.
Figures 2, 3:
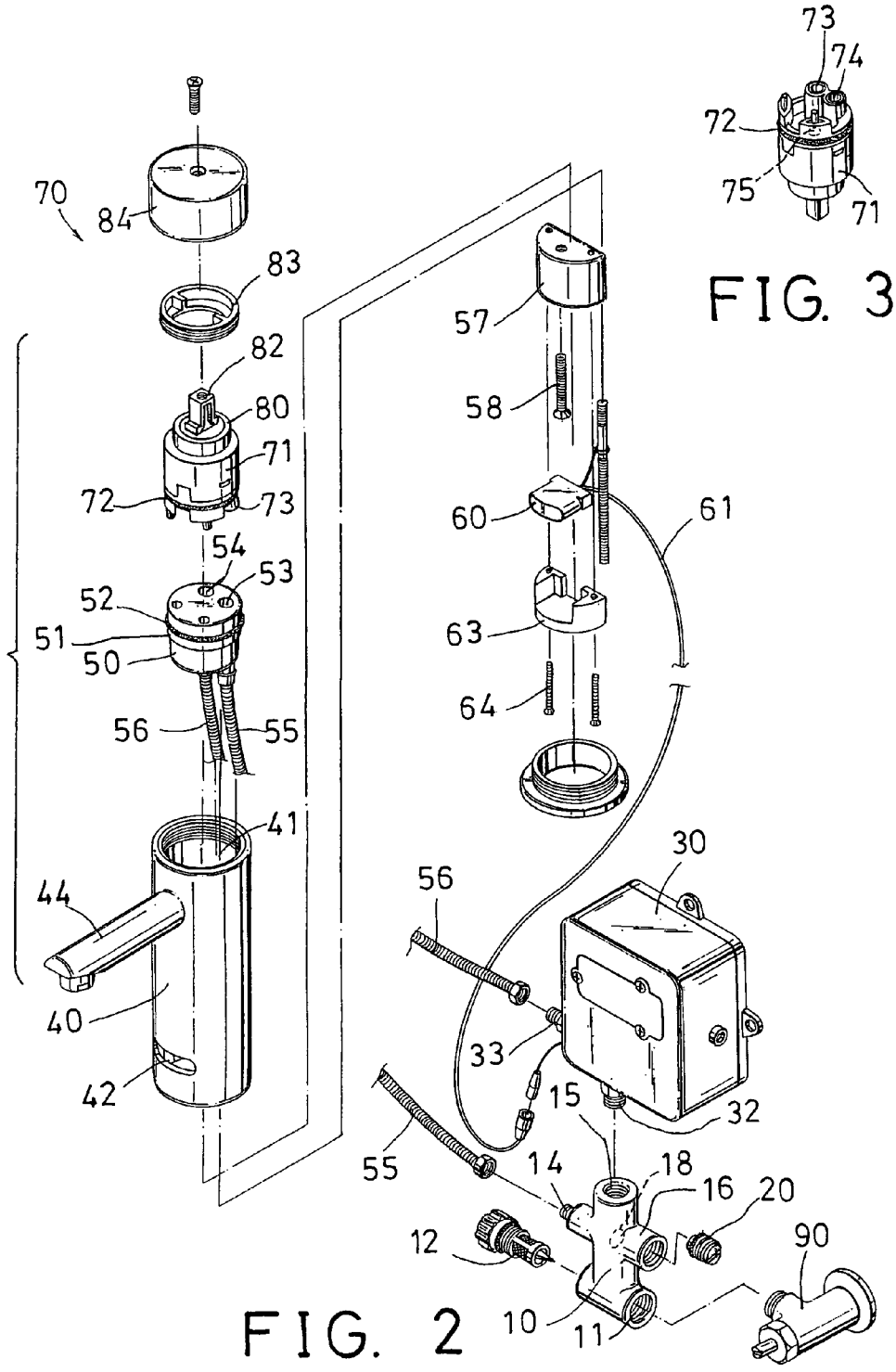
FIG. 2 is a partial exploded view of the faucet device.
FIG. 3 is a bottom perspective view of a control valve member for the faucet device.

Referring to the drawings, and initially to FIGS. 1–4, a faucet device in accordance with the present invention comprises a shank 10 including an inlet 11 coupled to a water reservoir via such as a tubing 90, to receive water from the water reservoir. It is preferable that a filter device 12 is engaged into the shank 10, for filtering the water flowing into the shank 10.

Figure 4:
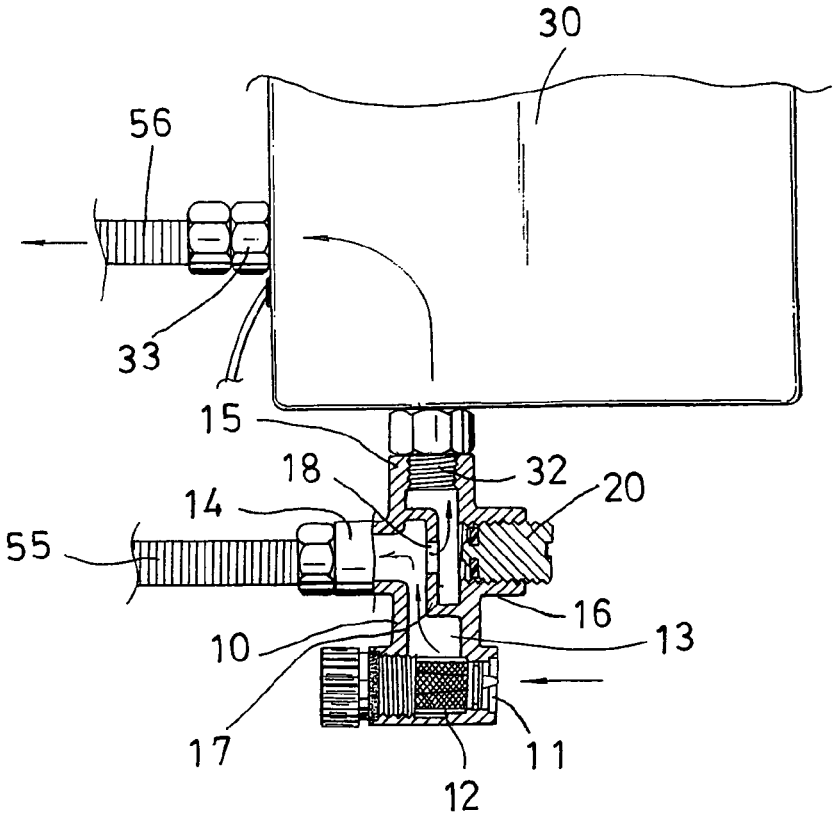
FIG. 4 is a partial cross sectional view of the faucet device, taken along lines 4—4 of FIG. 1.
Figure 5:
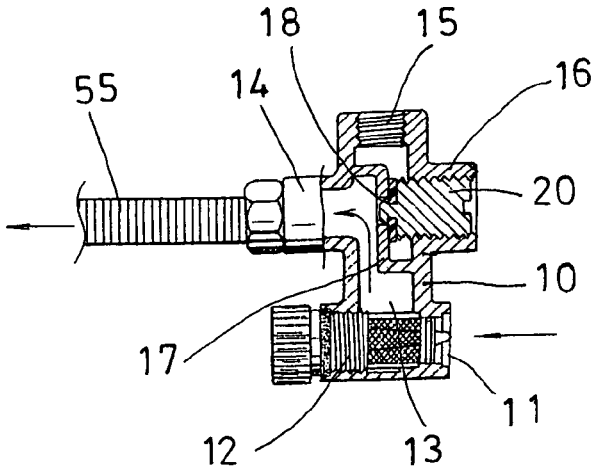
FIG. 5 is a partial cross sectional view similar to FIG. 4, illustrating the operation of the faucet device.

As shown in FIGS. 4, 5, the shank 10 includes a space 13 formed therein, and includes two outlets 14, 15 communicating with the inner space 13 thereof, for the water to flow out of the shank 10, and includes an opening 16 formed therein for threading with a valve element 20 therein. The shank 10 further includes a partition 17 disposed in the space 13 thereof, and the partition 17 is disposed between the outlets 14, 15 thereof, and includes an orifice 18 formed therein.

As also shown in FIGS. 4, 5, the water flowing into the shank 10 and/or filtered by the filter device 12 may flow out through the outlet 14, and may flow through the orifice 18 of the partition 17 before the water may flow out through the other outlet 15 of the shank 10. The valve element 20 may be threaded or moved or adjusted relative to the shank 10, to engage with the partition 17, and to selectively block the orifice 18 of the partition 17 (FIG. 5), to selectively prevent the water from flowing out through the other outlet 15 of the shank 10. The water may flow out through the other outlet 15 of the shank 10 when the valve element 20 is threaded or moved away from the orifice 18 of the partition 17 (FIG. 4).

A solenoid valve 30 includes an entrance 32 coupled to the other outlet 15 of the shank 10, for receiving the water from the shank 10, and includes an exit 33. The solenoid valve 30 is typical and is provided to control the water to selectively flow from the entrance 32 thereof to the exit 33 thereof, or to allow the water to selectively flow out through the exit 33 thereof, when the solenoid valve 30 is actuated or operated.

Figure 6:
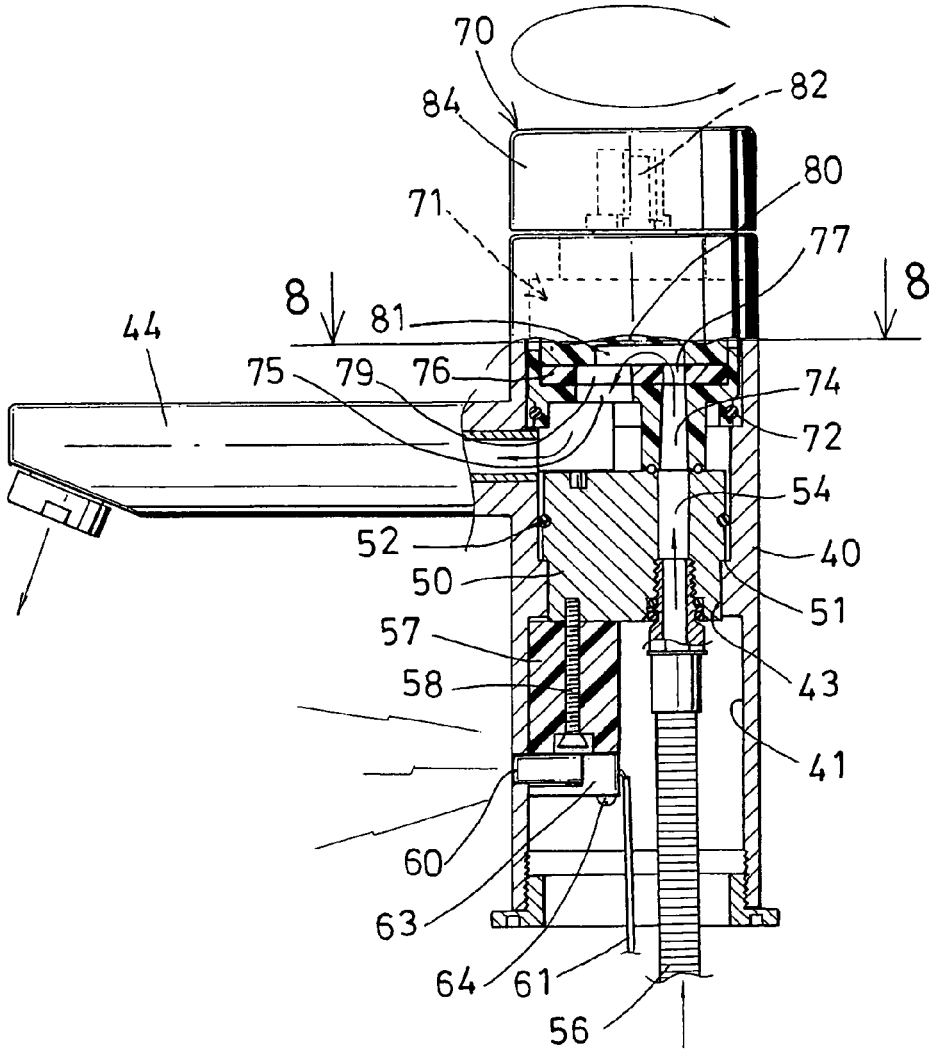
FIG. 6 is a partial cross sectional view of the faucet device, taken along lines 6—6 of FIG. 1.
Figure 7:
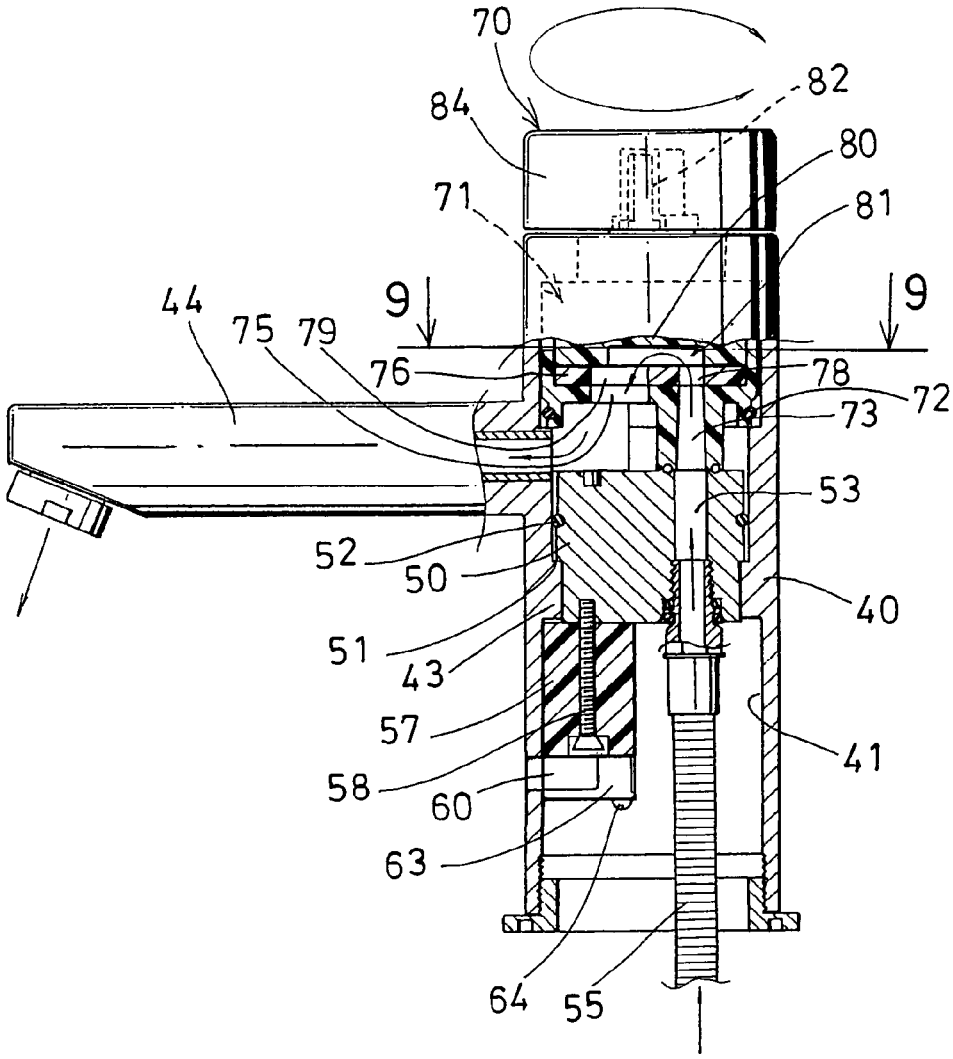
FIG. 7 is a partial cross sectional view similar to FIG. 6, taken along lines 7—7 of FIG. 1, illustrating the operation of the faucet device.

The faucet device further includes a faucet housing 40 having chamber 41 formed therein, and having an aperture 42 formed in the lower portion thereof (FIG. 2) and communicating with the chamber 41 thereof, and preferably having a peripheral protuberance 43 radially extended into the chamber 41 thereof (FIGS. 6, 7). The faucet housing 40 includes a sprayhead or a spigot or a spout 44 extended therefrom and communicating with the chamber 41 thereof, to allow the water to flow out of the faucet housing 40 through the spout 44 of the faucet housing 40.

A valve casing 50 is disposed or engaged into the chamber 41 of the faucet housing 40, and preferably includes a peripheral shoulder 51 formed therein, for receiving or engaging with the peripheral protuberance 43 of the faucet housing 40, and thus for anchoring or securing the valve casing 50 within the chamber 41 of the faucet housing 40. It is preferable that one or more sealing rings 52 are provided and engaged between the valve casing 50 and the faucet housing 40, to make a water tight seal between the valve casing 50 and the faucet housing 40.

The valve casing 50 includes two passages 53, 54 formed therein, and coupled to the outlet 14 of the shank 10 and to the exit 33 of the solenoid valve 30 with hoses 55, 56 respectively, for selectively receiving the water from the outlet 14 of the shank 10 and from the exit 33 of the solenoid valve 30. A block 57 may be secured to the valve casing 50 with one or more fasteners 58, and may be engaged with the peripheral protuberance 43 of the faucet housing 40 (FIGS. 6, 7), to solidly secure the valve casing 50 within the chamber 41 of the faucet housing 40.

A remote detecting device 60, such as a light emitting module or device 60, particularly an infrared light emitting device 60 or an infrared light emitting and/or receiving device 60 may further be provided and coupled to the solenoid valve 30 via an electric wire or cable 61, and may also be disposed in the chamber 41 of the faucet housing 40, and preferably engaged in the aperture 42 of the faucet housing 40 (FIGS. 1, 6, 7), for generating infrared rays, to detect whether one or more users or people are going toward or close to the faucet housing 40 or not.

The detecting device 60 may be directly secured to the faucet housing 40 and/or secured to the block 57 with a bracket 63 and/or one or more fasteners 64, and the detecting device 60 is provided to actuate or to operate the solenoid valve 30 and to allow or to control the water to selectively flow out through the exit 33 of the solenoid valve 30, when the detecting device 60 has detected that one or more users or people are going toward or close to the faucet housing 40.

In operation, for example, when one or more users or people have been detected to go toward or close to the faucet housing 40 by the detecting device 60, the solenoid valve 30 may be actuated or operated to control and to allow the water to selectively or automatically flow out through the exit 33 of the solenoid valve 30, and thus to prevent the faucet device from being operated or actuated by users manually.

The faucet device further includes an actuating device 70 attached to the faucet housing 40, to control the water to flow out through the spout 44 of the faucet housing 40 selectively via either of the passages 53, 54 of the valve casing 50. For example, the actuating device 70 includes a receptacle 71 received or secured in the chamber 41 of the faucet housing 40, and preferably includes one or more sealing rings 72 are provided and engaged between the receptacle 71 and the faucet housing 40, to make a water tight seal between the receptacle 71 and the faucet housing 40.

The actuating device 70 further includes two ports 73, 74 provided on or extended from the receptacle 71, and engaged with or coupled to the passages 53, 54 of the valve casing 50 respectively, to receive water from the shank 10 and the solenoid valve 30 via the hoses 55, 56 respectively. The actuating device 70 further includes a central bore 75 formed in the receptacle 71 and offset from the ports 73, 74 thereof, best shown in FIGS. 3 and 6–7, and communicating with the spout 44 of the faucet housing 40.

A gasket or valve plate 76 is disposed in the receptacle 71, and includes two apertures 77, 78 and a central pathway 79 formed therein (FIGS. 6–9), and aligned with the ports 73, 74 and the central bore 75 of the receptacle 71 respectively. It is preferable that the valve plate 76 is made of rubber or china or porcelain materials.

Figure 8:
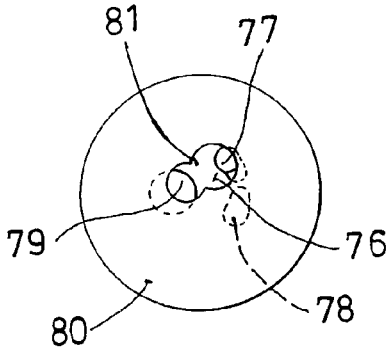
FIGS. 8, 9 are partial cross sectional views taken along lines 8—8 and 9—9 of FIGS. 6 and 7 respectively.
Figure 9:
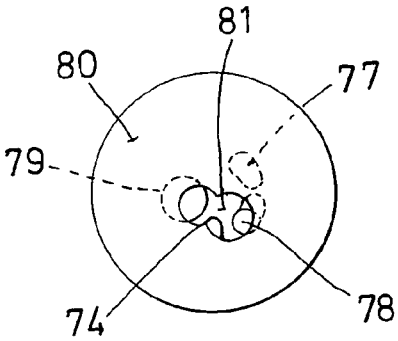

An adapter 80 is rotatably received or engaged in the receptacle 71, and includes an oblong hole 81 formed therein, best shown in FIGS. 8 and 9, and includes a stem 82 extended upwardly therefrom and outwardly of the receptacle 71. The adapter 80 may be rotatably attached or secured to the receptacle 71 with a coupler 83. A cap 84 may be attached or secured to the stem 82, for rotating the adapter 80 relative to the receptacle 71. It is also preferable that the adapter 80 is made of rubber or china or porcelain materials.

As shown in FIGS. 8 and 9, the adapter 80 may be rotated relative to the receptacle 71 with the cap 84, and the oblong hole 81 of the adapter 80 may be selectively communicate or connect the pathway 79 of the valve plate 76 with either aperture 77 or 78, or may be selectively communicate or connect the center bore 75 with either port 73 or 74, and thus to allow the water from the shank 10 and the solenoid valve 30 and the ports 73, 74 of the actuating device 70 to selectively flow out through the central bore 75 of the receptacle 71 (FIGS. 6, 7), and then to flow out through the spout 44 of the faucet housing 40.

In operation, as shown in FIGS. 4 and 6, when one or more users or people have been detected to go toward or close to the faucet housing 40 by the detecting device 60, the solenoid valve 30 may be actuated or operated to control and to allow the water to flow out automatically through the exit 33 of the solenoid valve 30, and then into the passage 54 of the valve casing 50 via the hose 56. The water may then flow out through the spout 44 of the faucet housing 40 when the oblong hole 81 of the adapter 80 is rotated to be connected with the pathway 79 and the aperture 77 of the valve plate 76 (FIG. 8).

When no users have been detected to go toward or close to the faucet housing 40 by the detecting device 60, the solenoid valve 30 will not be actuated or operated, and may shut or turned off the water flowing path to the exit 33 of the solenoid valve 30, and may thus be used to stop and to prevent the water to flow out through the exit 33 of the solenoid valve 30 at this moment.

Alternatively, as shown in FIGS. 7 and 9, when the adapter 80 is rotated relative to the valve plate 76 and the receptacle 71 with the cap 84 manually by the users, the oblong hole 81 of the adapter 80 may connect the pathway 79 and the other aperture 78 of the valve plate 76 with each other, to allow the water from the outlet 14 of the shank 10 to flow into the port 73 of the receptacle 71, and to flow through the other aperture 78 and the pathway 79 of the valve plate 76, and then to flow out through the spout 44 of the faucet housing 40.

As shown in FIG. 9, when the adapter 80 is rotated relative to the valve plate 76 and the receptacle 71, and when the oblong hole 81 of the adapter 80 connects the pathway 79 and the other aperture 78 of the valve plate 76 with each other, the aperture 77 of the valve plate 76 may be blocked, such that the water from the solenoid valve 30 may not flow out through the spout 44 of the faucet housing 40 at this moment. The water from either of the passages 53, 54 of the valve casing 50 may thus selectively communicating with the spout 44 of the faucet housing 40, to allow the water from the shank 10 and the solenoid valve 30 to selectively flow out through the spout 44 of the faucet housing 40.

As shown in FIG. 5, when the solenoid valve 30 is damaged or out of order, for example, and when the solenoid valve 30 is required to be repaired or to be changed with a new one, the valve element 20 may be threaded or moved relative to the shank 10, to engage with the partition 17, and to selectively block the orifice 18 of the partition 17, and thus to prevent the water from flowing out through the other outlet 15 of the shank 10 and through the solenoid valve 30.

The faucet device in accordance with the present invention may thus be selectively operated automatically by the solenoid valve 30, and may also be manually operated by the users with the cap 84 and the adapter 80, to allow the faucet device to be operated manually when electric energy or electric power is cut off.

Accordingly, the faucet device in accordance with the present invention is selectively operatable automatically and/or manually by users, to allow the faucet device to be operated manually by the users without electric energy.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A faucet device comprising:

a shank for coupling to a water reservoir and for receiving water from the water reservoir, said shank including a space formed therein, and including a first outlet and a second outlet communicating with said space thereof, for allowing the water to flow out of said shank via either said first outlet or said second outlet of said shank, a solenoid valve including an entrance coupled to said second outlet of said shank, and including an exit, for receiving the water from said shank, and for controlling the water to selectively flow out through said exit thereof, a faucet housing including a chamber formed therein, and including a spout extended therefrom and communicating with said chamber thereof, to allow water to flow out of said faucet housing through said spout, a valve casing disposed in said chamber of said faucet housing, and including a first passage and a second passage formed therein, and coupled to said first outlet of said shank and said exit 33 of said solenoid valve respectively, for selectively receiving the water from said shank and said solenoid valve respectively, and actuating means for selectively communicating said first passage and said second passage of said valve casing with said spout of said faucet housing, to allow the water from said shank to selectively flow out through said spout of said faucet housing, and to allow the water from said solenoid valve to selectively flow out through said spout of said faucet housing.

2. The faucet device as claimed in claim 1, wherein said actuating means includes a receptacle disposed in said chamber of said faucet housing, said receptacle includes a first port and a second port provided therein and coupled to said first and said second passages of said valve casing respectively, to receive the water from said shank and said solenoid valve respectively, said receptacle includes a central bore formed therein and offset from said first and said second ports, and communicating with said spout of said faucet housing.

3. The faucet device as claimed in claim 2, wherein said actuating means includes an adapter rotatably received in said receptacle, and having an oblong hole formed therein, for selectively connecting said center bore of said receptacle with either said first port or said second port of said receptacle.

4. The faucet device as claimed in claim 3, wherein said adapter includes a stem extended therefrom, and a cap attached to said stem, for rotating said adapter relative to said receptacle.

5. The faucet device as claimed in claim 3, wherein said receptacle includes a valve plate disposed in the receptacle, and having two apertures and a central pathway formed therein, and aligned with said first and said second ports and said central bore of said receptacle respectively, said oblong hole of said adapter selectively connects said central pathway of said valve plate with either of said apertures of said valve plate.

6. The faucet device as claimed in claim 1 further comprising a remote detecting device coupled to said solenoid valve, to detect whether people are going toward said faucet housing or not, and to actuate said solenoid valve and to allow the water to selectively flow out through said exit of said solenoid valve, when said detecting device has detected that people are going toward said faucet housing.

7. The faucet device as claimed in claim 6, wherein said receptacle includes a block secured to said valve casing, and said detecting device is secured to said block with a bracket.

8. The faucet device as claimed in claim 1, wherein said shank includes a filter device engaged therein, for filtering the water flowing into said shank.

9. The faucet device as claimed in claim 1, wherein said shank includes a partition disposed in said space thereof, and said partition is disposed between said first and said second outlets of said shank.

10. The faucet device as claimed in claim 9, wherein said partition has an orifice formed therein, to allow said first and said second outlets of said shank to be communicated with each other.

11. The faucet device as claimed in claim 10, wherein said shank includes a valve element treaded thereto, and selectively engageable with said partition, to selectively block said orifice of said partition, and to selectively prevent the water from flowing out through said second outlet of said shank.

12. The faucet device as claimed in claim 1, wherein said faucet housing includes a peripheral protuberance radially extended into said chamber thereof, said valve casing includes a peripheral shoulder formed therein, for engaging with said peripheral protuberance of said faucet housing, and for securing said valve casing within said chamber of said faucet housing.

* * * * *